US010278561B2

(12) United States Patent
Zou

(10) Patent No.: US 10,278,561 B2
(45) Date of Patent: May 7, 2019

(54) INTELLIGENT FLOOR MOPPING APPARATUS

(71) Applicant: FINE DRAGON TECHNOLOGY LIMITED, Shenzhen, Guangdong OT (CN)

(72) Inventor: Zhenren Zou, Guangdong (CN)

(73) Assignee: FINE DRAGON TECHNOLOGY LIMITED, Shenzhen (CN)

( * ) Notice: Subject to any disclaimer, the term of this patent is extended or adjusted under 35 U.S.C. 154(b) by 172 days.

(21) Appl. No.: 15/403,167

(22) Filed: Jan. 10, 2017

(65) Prior Publication Data

US 2018/0140152 A1 May 24, 2018

(30) Foreign Application Priority Data

Nov. 21, 2016 (CN) ..... 2016 2 1243897

(51) Int. Cl.
*A47L 11/282* (2006.01)
*A47L 11/40* (2006.01)

(52) U.S. Cl.
CPC ..... *A47L 11/4011* (2013.01); *A47L 11/282* (2013.01); *A47L 11/4036* (2013.01); *A47L 11/4038* (2013.01); *A47L 11/4061* (2013.01); *A47L 11/40* (2013.01); *A47L 2201/00* (2013.01); *A47L 2201/04* (2013.01)

(58) Field of Classification Search
CPC ..... A47L 11/4038; A47L 11/4069; A47L 11/4011
USPC ..... 15/98
See application file for complete search history.

(56) References Cited

U.S. PATENT DOCUMENTS

| | | | | |
|---|---|---|---|---|
| 6,741,054 | B2 * | 5/2004 | Koselka | A47L 11/24 15/3 |
| 8,245,351 | B2 * | 8/2012 | Rosenzweig | A47L 13/16 15/228 |
| 8,452,450 | B2 * | 5/2013 | Dooley | G05D 1/0234 700/258 |
| 9,149,168 | B2 * | 10/2015 | Baek | A47L 9/009 |
| 9,317,038 | B2 * | 4/2016 | Ozick | A47L 9/009 |
| 9,907,449 | B2 * | 3/2018 | Lu | A47L 9/0673 |
| 2015/0182090 | A1 * | 7/2015 | Park | A47L 11/4069 15/98 |
| 2016/0015234 | A1 * | 1/2016 | Smith | A47L 11/12 15/98 |
| 2017/0360269 | A1 * | 12/2017 | Chao | A47L 11/305 |

* cited by examiner

*Primary Examiner* — Michael D Jennings

(57) ABSTRACT

The present application provides an intelligent floor mopping apparatus, including: a body, a driving mechanism, a cleaning mechanism, and a sensing mechanism. The driving mechanism is disposed on the body, and is adapted to drive the body to move. The sensing mechanism is disposed on the body, and is adapted to sense the situation of a floor of an area to be cleaned, so as to adjust the moving direction of the body. The cleaning mechanism is disposed below the body for cleaning the floor and includes two circular mopping blocks and one rectangular mopping block. The two circular mopping blocks are disposed side by side below a front part of the bottom of the body and are rotatable parallel to the floor, and the rectangular mopping block is disposed below a rear part of the bottom of the body.

8 Claims, 2 Drawing Sheets

INTELLIGENT FLOOR MOPPING APPARATUS

CROSS-REFERENCE TO PRIOR APPLICATION

The present application claims the benefit of Chinese Utility Model Application No. 201621243897.1 filed on Nov. 21, 2016, the contents of which are incorporated herein by reference.

BACKGROUND

Technical Field

The present application relates to a floor cleaning and mopping apparatus, and in particular, to an intelligent floor mopping apparatus.

Related Art

Currently, a common floor mopping apparatus available on the market generally uses one rectangular mopping block or two circular mopping blocks as its mopping mechanism. As regards a floor mopping apparatus with one rectangular mopping block, because there is only one mopping block and the mopping block keeps moving forward during working, it cannot easily wipe off stubborn dirt from the floor. As regards a floor mopping apparatus with two circular mopping blocks, because there is a clearance between the two circular mopping blocks, it cannot clean dust and dirt in the clearance, that is, there is a dead spot for cleaning, resulting in a poor cleaning effect.

SUMMARY

The present application provides an intelligent floor mopping apparatus, which can resolve the problem in the prior art that a floor mopping apparatus with one rectangular mopping block cannot easily wipe off stubborn dirt from the floor and a floor mopping apparatus with two circular mopping blocks also has a poor cleaning effect because there is a dead spot for cleaning.

To resolve the foregoing problem, the present application provides the following technical solution: An intelligent floor mopping apparatus, including a body, a driving mechanism, a cleaning mechanism, and a sensing mechanism, where the driving mechanism is disposed on the body, and is adapted to drive the body to move;

the sensing mechanism is disposed on the body, and is adapted to sense the situation of a floor of an area to be cleaned, so as to adjust the moving direction of the body; and the cleaning mechanism is disposed below the body for cleaning the floor and includes two circular mopping blocks and one rectangular mopping block, the two circular mopping blocks are disposed side by side below a front part of the bottom of the body and are rotatable parallel to the floor, and the rectangular mopping block is disposed below a rear part of the bottom of the body.

Each of the circular mopping blocks includes a circular wiper and a circular rack, the two circular racks are disposed side by side below the front part of the bottom of the body and are connected to the driving mechanism, the driving mechanism is further adapted to drive the circular racks to rotate, and the two circular wipers are respectively connected to the two circular racks, so that the two circular wipers are driven to rotate along with the rotation of the two circular racks.

The two circular wipers are respectively connected to the two circular racks by means of Velcro-tapes.

The rectangular mopping block includes a rectangular wiper, a rectangular rack, and two wiper pressing members, the two wiper pressing members are separately disposed at two sides of an axis of symmetry in the rectangular rack, each of the wiper pressing members includes two rotating arms and one pressing arm, one ends of the two rotating arms are respectively connected to two ends of the pressing arm, the other ends of the two rotating arms are rotatably connected to the rectangular rack, and when the wiper pressing members rotate to a coplanar position with respect to the rectangular rack, the pressing arms tightly press against an inner wall surface of the rectangular rack, so that the rectangular wiper is tightly clamped by means of cooperation between the pressing arms and the rectangular rack.

The rectangular mopping block further includes lifting members, secured to the pressing arms for lifting the pressing arms.

The rectangular mopping block further includes a connecting member, the connecting member is secured to the rectangular rack, and the rectangular mopping block is detachably connected to the body by means of the connecting member.

The sensing mechanism includes a first sensor, disposed directly in front of the body and adapted to sense the distance between the intelligent floor mopping apparatus and a wall towards which the intelligent floor mopping apparatus moves.

The sensing mechanism further includes a second sensor, disposed at a frontmost end directly in front of the body and adapted to sense whether the intelligent floor mopping apparatus collides with an obstacle.

The sensing mechanism further includes a third sensor, disposed at a frontmost end of the bottom of the body and adapted to sense the distance between the floor towards which the intelligent floor mopping apparatus moves and the bottom of the body.

As compared with the prior art, in the present application, two circular mopping blocks and a rectangular mopping block are disposed below the body. The two circular mopping blocks can rotate at a high speed to mop the floor and wipe off stubborn dirt, and the rectangular moping block can mop the area that the two circular mopping blocks cannot cover, thereby improving the cleaning effect. In addition, in the present application, the arrangement of the first sensor, the second sensor, and the third sensor prevents the body from damage caused by collision and falling, and also can optimize the mopping route.

BRIEF DESCRIPTION OF THE DRAWINGS

To describe the technical solutions of the embodiments of the present application more clearly, the following briefly introduces the accompanying drawings required for describing the embodiments. Apparently, the accompanying drawings in the following description show only some embodiments of the present application, and a person of ordinary skill in the art may still derive other drawings from these accompanying drawings without creative efforts.

DETAILED DESCRIPTION

The following clearly and completely describes the technical solutions in the embodiments of the present application with reference to the accompanying drawings in the embodiments of the present application. Apparently, the described embodiments are some of the embodiments of the present application rather than all of the embodiments. All other embodiments obtained by a person of ordinary skill in the art based on the embodiments of the present application without creative efforts shall fall within the protection scope of the present application.

Figure 1:
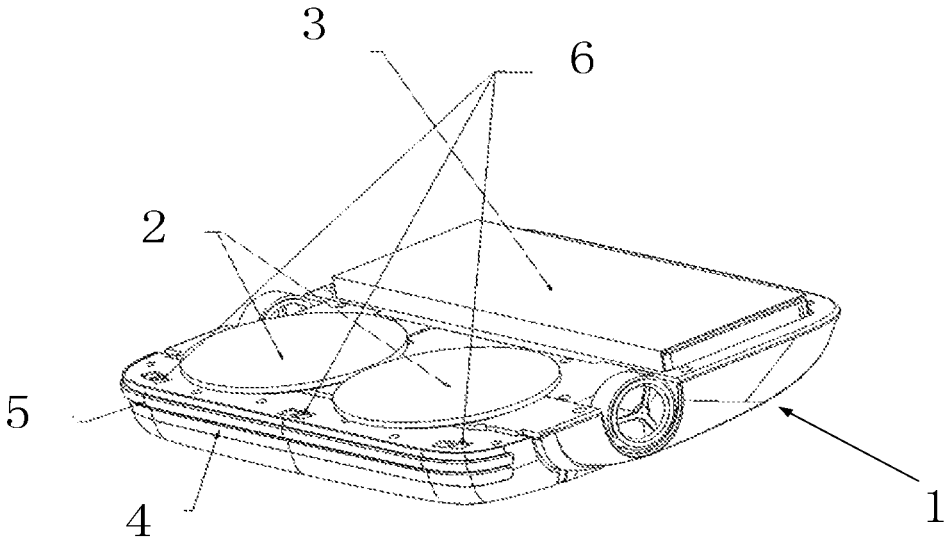
FIG. 1 is a bottom view of an intelligent floor mopping apparatus according to the present application.

Referring to FIG. 1, FIG. 1 is a bottom view of an intelligent floor mopping apparatus according to the present application. The present application provides an intelligent floor mopping apparatus, including a body 1, a driving mechanism (not shown in the figure), a cleaning mechanism, and a sensing mechanism. The driving mechanism is disposed on the body 1, and is adapted to drive the body to move. The sensing mechanism is disposed on the body 1, and is adapted to sense the situation of a floor of an area to be cleaned, so as to adjust the moving direction of the body 1.

The cleaning mechanism is disposed below the body 1 for cleaning the floor and includes two circular mopping blocks 2 and one rectangular mopping block 3. The two circular mopping blocks 2 are disposed side by side below a front part of the bottom of the body 1 and are rotatable parallel to the floor. The rectangular mopping block 3 is disposed below a rear part of the bottom of the body 1.

For example, when the intelligent floor mopping apparatus moves forward, the two circular mopping blocks 2 in the front thereof keep rotating and can wipe off stubborn dirt, and the rectangular mopping block 3 in the rear thereof not only can further wipe off dirt that the two circular mopping blocks 2 fail to clean, but also can wipe off dust and dirt in the clearance between the two circular mopping blocks 2, that is, the "dead spot" area.

Figure 2:
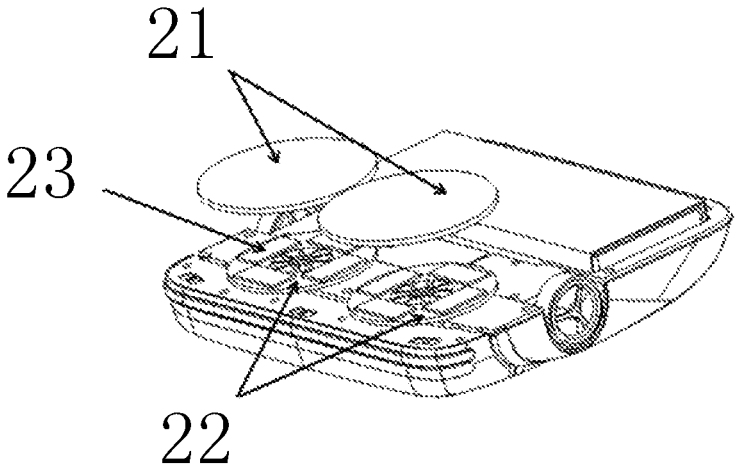
FIG. 2 is a schematic view illustrating the structure and installation of circular mopping blocks according to the present application.

Referring to FIG. 2, FIG. 2 is a schematic view illustrating the structure and installation of circular mopping blocks according to the present application. Each of the circular mopping blocks 2 includes a circular wiper 21 and a circular rack 22. The two circular racks 22 are disposed side by side below the front part of the bottom of the body 1 and are connected to the driving mechanism. The driving mechanism is further adapted to drive the circular racks 22 to rotate. The two circular wipers 21 are respectively connected to the circular racks 22, so that the two circular wipers 21 are driven to rotate along with the rotation of the two circular racks 22, so as to mop the floor.

Further, the two circular wipers 21 may be respectively connected to the two circular racks 22 by means of Velcro-tapes 23, so that the two circular wipers 21 can be easily removed from the circular racks 22 for washing or replacement.

Figure 3:
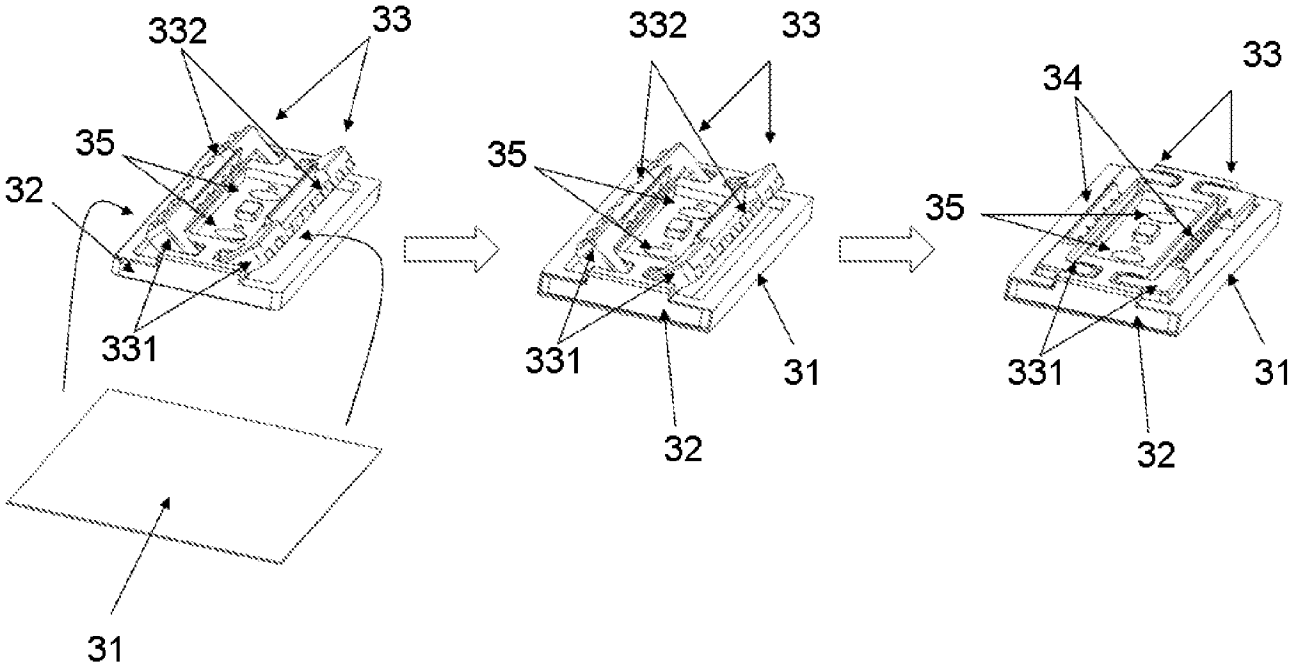
FIG. 3 is a schematic view illustrating the structure and installation of a rectangular mopping block according to the present application.

Referring to FIG. 3, FIG. 3 is a schematic view illustrating the structure and installation of a rectangular mopping block according to the present application. The rectangular mopping block 3 includes a rectangular wiper 31, a rectangular rack 32, and two wiper pressing members 33. The two wiper pressing members 33 are separately disposed at two sides of an axis of symmetry in the rectangular rack 32. Each of the wiper pressing members 33 includes two rotating arms 331 and one pressing arm 332. One ends of the two rotating arms 331 are respectively connected to two ends of the pressing arm 332, and the other ends of the two rotating arms 331 are rotatably connected to the rectangular rack 32. When the wiper pressing members 33 rotate to a coplanar position with respect to the rectangular rack 32, the pressing arms 332 tightly press against an inner wall surface of the rectangular rack 32, so that the rectangular wiper 31 is tightly clamped by means of cooperation between the pressing arms 332 and the rectangular rack 32. It would be appreciated that when the rectangular wiper 31 needs to be removed, one only needs to rotate the pressing arms 332 away from the wall surface of the rectangular rack 32. By means of the arrangement of the wiper pressing members 33, the rectangular wiper 31 can be easily removed from the rectangular rack 32 for washing or replacement.

The rectangular mopping block 3 further includes lifting members 34, secured to the pressing arms 332 for lifting the pressing arms 332. By means of the arrangement of the lifting members 34, the pressing arms 332 can be easily lifted for rotation.

Further, the rectangular mopping block 3 further includes a connecting member 35, the connecting member 35 is secured to the rectangular rack 32, and the rectangular mopping block 3 is detachably connected to the body 1 by means of the connecting member 35. Specifically, the connecting member 35 is provided therein with two permanent magnets, and the body 1 is provided with two iron sheets at positions corresponding to the connecting member 35 on the rectangular mopping block 3. The rectangular mopping block 3 is attached to the body 1 through magnetic attraction between the magnets of the connecting member 35 and the iron sheets of the body 1. By means of the magnetic attraction between the magnets and the iron sheets, the rectangular rack 32 can be easily removed from or mounted onto the body 1.

It would be appreciated that in other embodiments, the connecting member 35 may be securely connected to the body in other manners such as fastening and adhesion.

The sensing mechanism includes a first sensor 4, disposed directly in front of the body 1 and adapted to sense the distance between the intelligent floor mopping apparatus and a wall towards which the intelligent floor mopping apparatus moves. When the distance between the intelligent floor mopping apparatus and the wall towards with the intelligent floor mopping apparatus moves reaches a set value, the floor mopping apparatus automatically turns in advance and moves towards another direction, thereby preventing the body 1 from colliding with the wall.

The sensing mechanism further includes a second sensor 5, disposed at a frontmost end directly in front of the body 1 and adapted to sense whether the intelligent floor mopping apparatus collides with an obstacle. When the second sensor 5 directly in the front of the intelligent floor mopping apparatus collides with an obstacle, the intelligent floor mopping apparatus automatically turns and moves towards another direction, thereby avoiding the obstacle.

The sensing mechanism further includes a third sensor 6, disposed at a frontmost end of the bottom of the body 1 and adapted to sense the distance between the floor towards which the intelligent floor mopping apparatus moves and the bottom of the body. When the distance between the frontmost end of the bottom of the front of the intelligent floor mopping apparatus to the floor exceeds a set value (for example, a stair), the intelligent floor mopping apparatus stops moving forward, automatically turns, and moves towards another direction, thereby protecting the intelligent floor mopping apparatus from damage caused by falling.

Based on the above, in the present application, two circular mopping blocks 2 and a rectangular mopping block 3 are disposed below the body. The two circular mopping blocks 2 can rotate at a high speed to mop the floor and wipe off stubborn dirt, and the rectangular moping block 3 can mop the area that the two circular mopping blocks cannot cover, thereby improving the cleaning effect. In addition, in the present application, the arrangement of the first sensor 4, the second sensor 5, and the third sensor 6 protects the body 1 from damage caused by collision and falling, and also can optimize the mopping route.

The foregoing descriptions are merely implementation manners of the present application but are not intended to limit the patent scope of the present application. Any equivalent modifications made to the structures or processes based on the content of the specification and the accompanying drawings of the present application for direct or indirect use in other relevant technical fields shall also be encompassed in the patent protection scope of the present application.

What is claimed is:

1. An intelligent floor mopping apparatus, comprising: a body, a driving mechanism, a cleaning mechanism, and a sensing mechanism, wherein the driving mechanism is disposed on the body, and is adapted to drive the body to move;

the sensing mechanism is disposed on the body, and is adapted to sense the situation of a floor of an area to be cleaned, so as to adjust the moving direction of the body; and the cleaning mechanism is disposed below the body for cleaning the floor and comprises two circular mopping blocks and one rectangular mopping block, the two circular mopping blocks are disposed side by side below a front part of the bottom of the body and are rotatable parallel to the floor, and the rectangular mopping block is disposed below a rear part of the bottom of the body;

wherein the rectangular mopping block comprises a rectangular wiper, a rectangular rack, and two wiper pressing members, the two wiper pressing members are separately disposed at two sides of an axis of symmetry in the rectangular rack, each of the wiper pressing members comprises two rotating arms and one pressing arm, one ends of the two rotating arms are respectively connected to two ends of the pressing arm, the other ends of the two rotating arms are rotatably connected to the rectangular rack, and when the wiper pressing members rotate to a coplanar position with respect to the rectangular rack, the pressing arms tightly press against an inner wall surface of the rectangular rack, so that the rectangular wiper is tightly clamped by means of cooperation between the pressing arms and the rectangular rack.

2. The intelligent floor mopping apparatus according to claim 1, wherein each of the circular mopping blocks comprises a circular wiper and a circular rack, the two circular racks are disposed side by side below the front part of the bottom of the body and are connected to the driving mechanism, the driving mechanism is further adapted to drive the circular racks to rotate, and the two circular wipers are respectively connected to the two circular racks, so that the two circular wipers are driven to rotate along with the rotation of the two circular racks.

3. The intelligent floor mopping apparatus according to claim 2, wherein the two circular wipers are respectively connected to the two circular racks by means of Velcro-tapes.

4. The intelligent floor mopping apparatus according to claim 1, wherein the rectangular mopping block further comprises lifting members, secured to the pressing arms for lifting the pressing arms.

5. The intelligent floor mopping apparatus according to claim 4, wherein the rectangular mopping block further comprises a connecting member, the connecting member is secured to the rectangular rack, and the rectangular mopping block is detachably connected to the body by means of the connecting member.

6. The intelligent floor mopping apparatus according to claim 1, wherein the sensing mechanism comprises a first sensor, disposed directly in front of the body and adapted to sense a distance between the intelligent floor mopping apparatus and a wall towards which the intelligent floor mopping apparatus moves.

7. The intelligent floor mopping apparatus according to claim 6, wherein the sensing mechanism further comprises a second sensor, disposed at a frontmost end directly in front of the body and is adapted to sense whether the intelligent floor mopping apparatus collides with an obstacle.

8. The intelligent floor mopping apparatus according to claim 7, wherein the sensing mechanism further comprises a third sensor, disposed at a frontmost end of the bottom of the body, and adapted to sense the distance between the floor towards which the intelligent floor mopping apparatus moves and the bottom of the body.

* * * * *